United States Patent [19]

Ogle et al.

[11] 4,086,516

[45] Apr. 25, 1978

[54] INTEGRATED CIRCUIT SYSTEM FOR OPERATING DISPLAY PANELS

[75] Inventors: James A. Ogle, Neshanic Station; James Y. Lee, Kendall Park, both of N.J.

[73] Assignee: Burroughs Corporation, Detroit, Mich.

[21] Appl. No.: 743,969

[22] Filed: Nov. 22, 1976

[51] Int. Cl.[2] ..... H05B 41/02

[52] U.S. Cl. ..... 315/169 R; 315/169 TV; 340/324 M

[58] Field of Search ..... 315/169 R, 169 TV; 340/324 M, 336

[56] References Cited

U.S. PATENT DOCUMENTS

| | | | |
|---|---|---|---|
| 3,846,646 | 11/1974 | Peters | 315/169 TV |
| 3,851,210 | 11/1974 | Schermerhorn | 315/169 TV |
| 3,893,101 | 7/1975 | Glaser | 315/169 TV |
| 3,976,912 | 8/1976 | Miavecz et al. | 315/169 TV |

OTHER PUBLICATIONS

"Application Notes," Burroughs Bulletin No. P102.

*Primary Examiner*—Maynard R. Wilbur
*Assistant Examiner*—Lawrence Goodwin
*Attorney, Agent, or Firm*—Kevin R. Peterson; Robert A. Green; Edward J. Feeney, Jr.

[57] ABSTRACT

The disclosure is of a system for driving gas-filled segment-type display panels including a plurality of groups of cathode electrodes, each having an anode electrode. The circuit includes means for holding the anodes at a relatively low potential for a short period of time after drive signals are applied thereto and to selected cathode electrodes. During this period of time, current flow charges a capacitor and raises the potential of the anodes to a potential at which ionization and cathode glow can occur. The circuit includes transistors utilized as resistors to hold off cathodes which are not intended to glow.

6 Claims, 4 Drawing Figures

Fig. 1
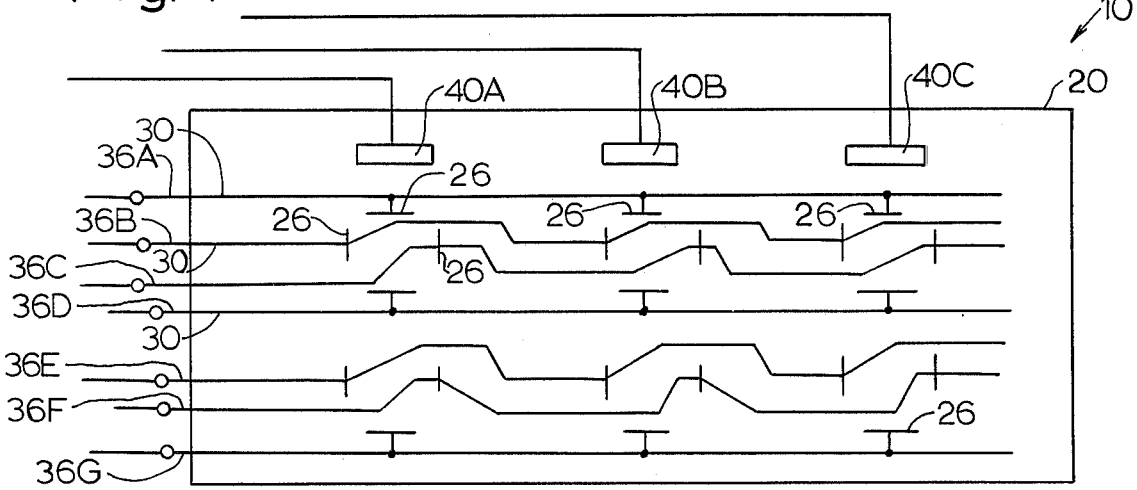
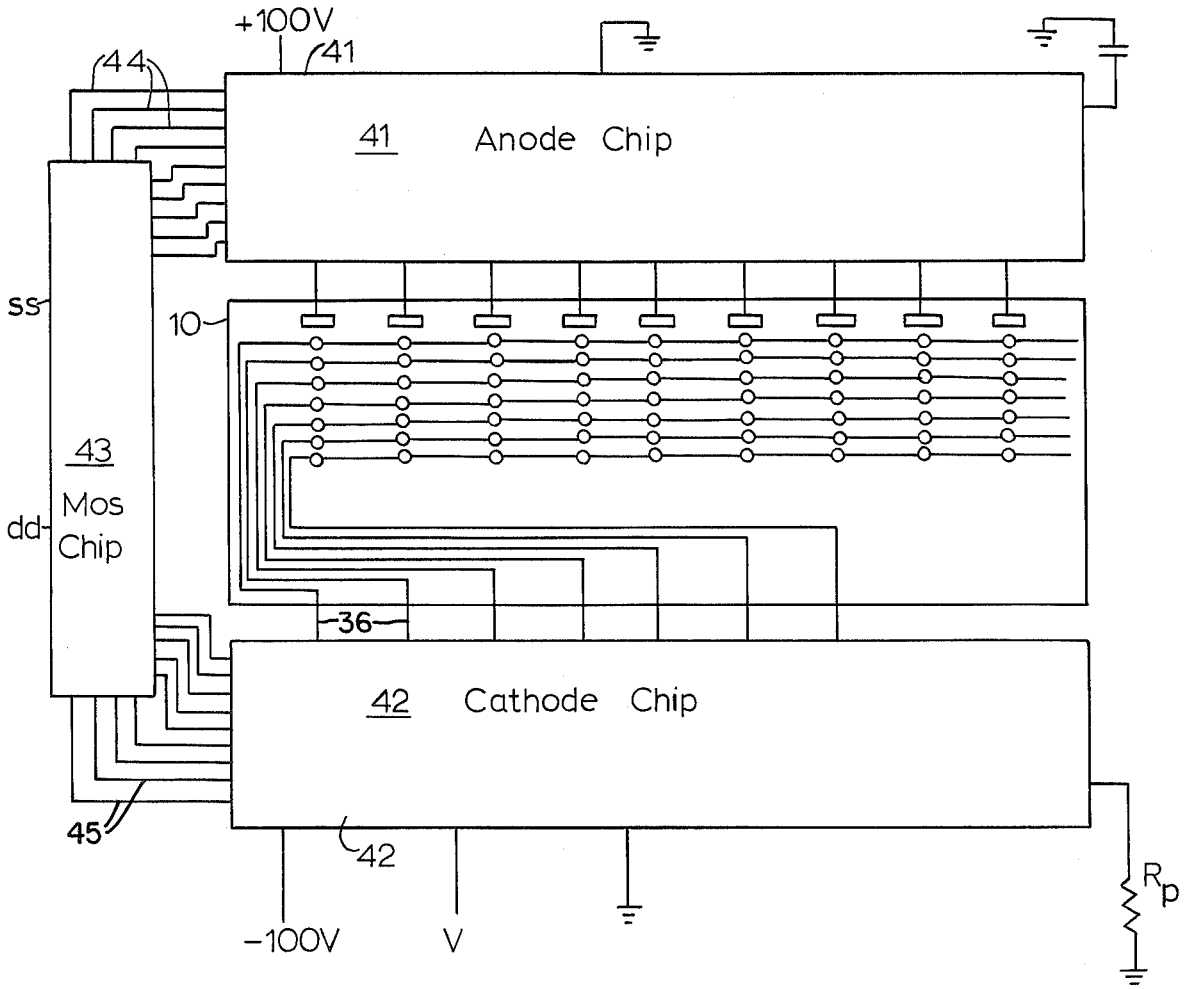
Fig. 2

INTEGRATED CIRCUIT SYSTEM FOR OPERATING DISPLAY PANELS

BACKGROUND OF THE INVENTION

Many drive circuits are known and used for operating multi-segment display panels of the type known as PANAPLEX panels. Panels of this type are described and claimed in U.S. Pat. No. 3,868,535. With the advent of integrated circuits, it has been a goal of the industry to devise a simple circuit for driving panels which could be manufactured as an integrated circuit. In general, the presence of resistors in a drive circuit complicates the development of an integrated circuit module therefrom.

SUMMARY OF THE INVENTION

The present invention overcomes the above problem by utilizing transistors as resistors in a circuit which provides protection for the integrated circuit module where the module is permitted voltage swings over a relatively narrow range.

DESCRIPTION OF THE DRAWINGS

FIG. 1 is a schematic representation of a display panel useful in practicing the invention;

FIG. 2 is another schematic representation of the display panel of FIG. 1 and circuit modules with which it may be operated;

DESCRIPTION OF THE PREFERRED EMBODIMENTS

Figure 3:
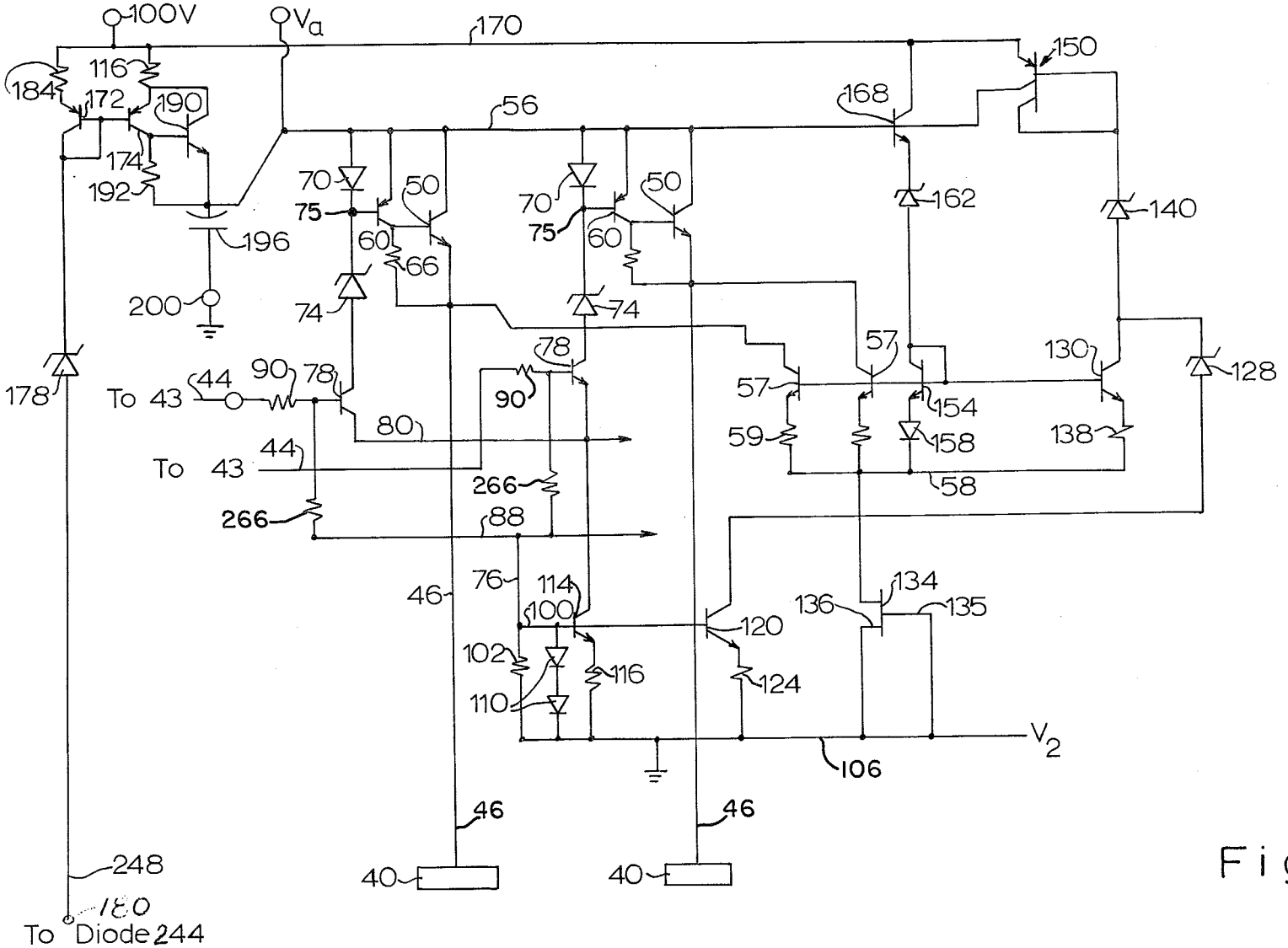
FIG. 3 is a schematic representation of a circuit used in the system shown in FIG. 2.

The present invention is useful to operate gas-filled display panels known as PANAPLEX panels which are shown in many patents including U.S. Pat. No. 3,868,535, which is incorporated herein by reference. Such a panel 10 is shown schematically in FIG. 1 and includes a gas-filled envelope which contains a plurality of groups of cathode electrode segments 26, corresponding cathode segments in each group being connected to a common cathode conductor 30. An external connection 36 is provided to each common cathode conductor so that each can be connected to a cathode drive circuit. In addition, an anode electrode 40 is provided in operative relation with each group of cathodes 26.

In one mode of operation of a panel of this type, groups of information signals are applied to the external cathode leads 36 and to the common cathode leads 30 inside the panel and thus to selected cathode segments 26 as each of the anode electrodes 40 is energized, in turn. Thus, as each anode electrode is energized, a character is displayed at each position in the panel by the particular cathode segments which are energized at that instant by signals applied to the conductors 36.

An electronic system for operating the panel 10 is shown schematically in block form in FIG. 2. Panel 10 is also shown in another schematic form. This apparatus includes an electronic chip or module 41 for driving the anodes of the panel, an electronic chip or module 42 for driving the cathodes of the panel, and an electronic chip or module 43 which provides the logic and timing for controlling the various circuit operations. Module 43 has (1) output terminals (not shown) at which anode logic levels are provided and from which leads 44 extend to the anode circuitry to be described, and (2) output terminals (not shown) at which cathode logic levels are provided and from which leads 45 extend to the cathode circuitry to be described. The anode and cathode circuit modules shown in block form in FIG. 2 are shown in greater detail in FIG. 3 and are described below.

In the following description of the circuit used to drive panel 10, various circuit elements such as grounds, some impedance elements, and some voltages may not be shown and described since they can be readily determined by those skilled in the art. In the system 20 and considering the anode portion thereof shown in FIG. 3, each anode 40 is connected (1) through the emitter-collector path of an NPN transistor 50 to bus 56, known as the "feedback regulated bus", (2) through the collector-emitter path of a PNP transistor 60, and (3) through the collector-emitter path of transistor 57 to bus 58 which is connected through a field effect transistor 134 to reference bus 106. A current flow path also extends from feedback regulated bus 56 through diode 70, Zener diode 74, and the collector-emitter NPN transistors 78 and 114 to bus 106 which is connected to ground. The base of transistor 60 is connected to the junction 75 of diodes 70 and 74.

The base of transistor 78 is connected (1) through a resistor 266 to bus 88 and (2) through resistor 90 and a lead 44 to one of the anode logic output terminals of logic module 43.

The foregoing circuit elements, except transistor 134, are provided for each anode 40.

The anode portion of system 20 also includes several individual modules, each of which operates with all of the anodes. One such module is a constant current source for the anodes, and this module includes a connection 76 from a bus 88 to a bus 100 and through a resistor 102 which is connected to bus 106. A pair of diodes 110, oriented as shown, is connected between the buses 100 and 106, and the bus 100 is connected to the base of a transistor 114 which has its emitter connected through a resistor 116 to the bus 106, and its collector connected to the bus 80 and thus to the emitters of all of the transistors 78 of each of the anode circuits.

Another common anode module, known as the housekeeping current compensator, includes NPN transistor 120 which is connected through Zener diode 128 to the collector of NPN transistor 130 which is in parallel with NPN transistor 154. Transistor 130 is connected through Zener diode 140 to double-collector transistor 150 and to bus 170. Transistor 154 is also connected from bus 58 through a Zener diode 162 and NPN transistor 168 to bus 170.

The anode circuit also includes a current multiplier which comprises back-to-back transistors 172 and 174, with the collector of transistor 172 connected through Zener diode 178 to lead 248 which is connected to the cathode circuit in a manner to be described. The emitters of the transistors 172 and 174 are coupled to the bus 170, and the collector of transistor 174 is connected directly to the base of transistor 190 and through a resistor 192 to its emitter. This connection also extends to the bus 56 and through an integrating capacitor 196 to reference voltage terminal 200 which is grounded. The collector of transistor 190 and the emitter of transistor 172 are connected together.

Figure 4:
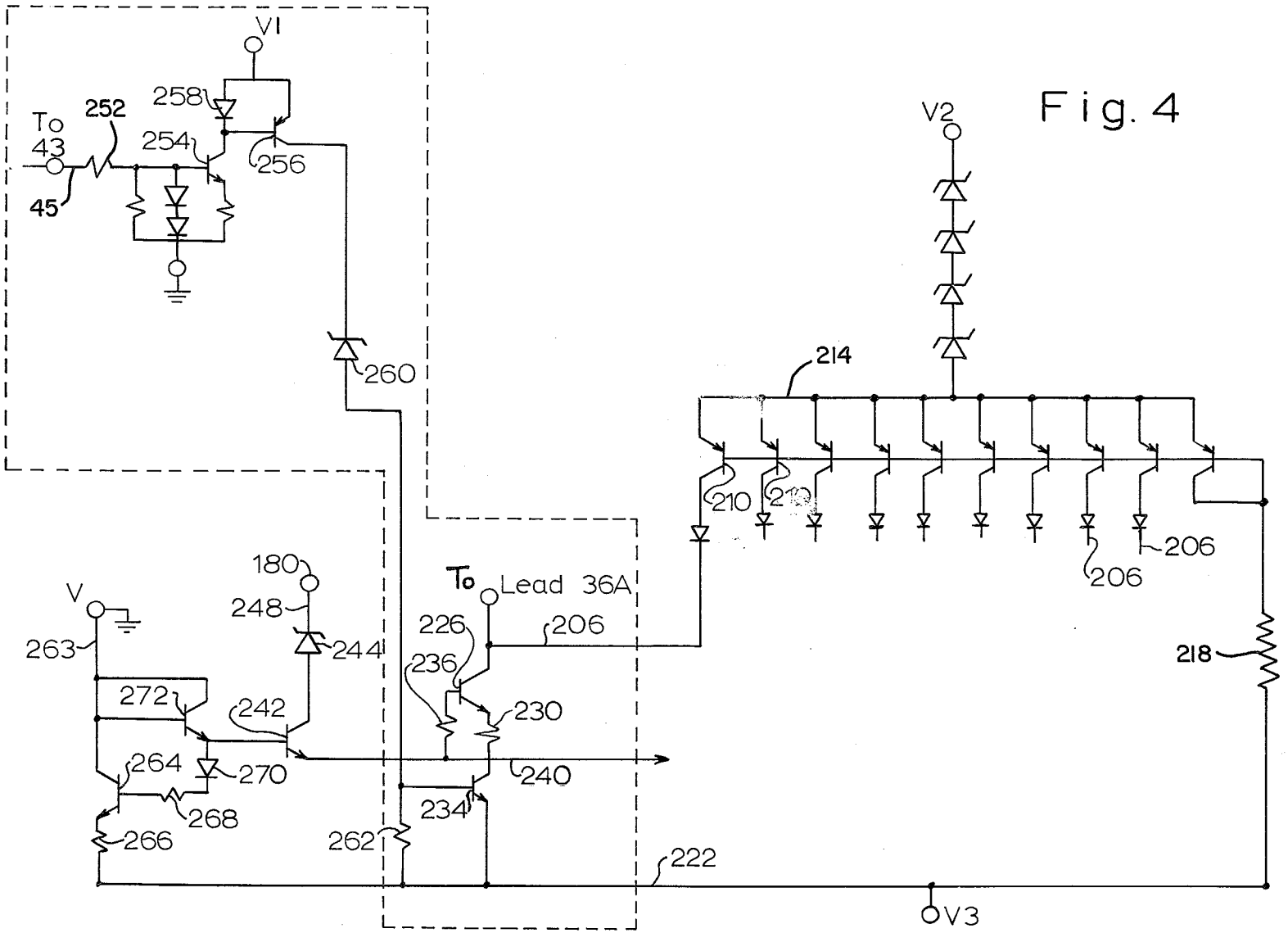
FIG. 4 is a schematic representation of a circuit used in the system of FIG. 2.

In the cathode operating portion of the system 20 shown in FIG. 4, each cathode lead 36 is connected by a lead 206 to the collector of a transistor 210, the emitter of which is connected to a bus 214, and the base of which is connected through a resistive path 218 to a bus 222. In addition, each cathode lead 36 is coupled through the collector-emitter path of an NPN transistor 226 and the collector-emitter path of a transistor 234 to bus 222. The base of transistor 226 is connected to a bus 240 which is connected through the emitter-collector path of transistor 242 and through diode 244 and lead 248 to diode 178 in the multiplier circuit of the anode circuit.

Each lead 45 from logic module 43 is connected through a resistor 252 to the base of an NPN transistor 254, the collector of which is connected (1) through a diode 258 to voltage source V1 and (2) to the base of a PNP transistor 256, which multiplies the current in transistor 254, the emitter of transistor 256 being connected to power supply V1 and the collector being connected through Zener diode 260 and transistors 234 and 226 to a common cathode lead 36.

A program current circuit which sets the cathode current for panel 10 is provided and includes a connection 263 from a bias voltage source, such as ground, through the collector-emitter path of an NPN transistor 264 to bus 222, which is connected to voltage source V3. The collector of transistor 264 is connected to the base of NPN transistor 272, the emitter of which is connected to the base of transistor 242, the emitter of which is connected to bus 240. The emitter of transistor 272 is connected (1) through diode 270 and resistor 268 to the base of transistor 264 and (2) to the base of transistor 242.

Each cathode common lead 36 is connected to its own group of circuit elements as shown enclosed in dash lines in FIG. 4.

The system includes or is coupled to a source (not shown) of data to be displayed in panel 10. Such data source may include a computer, suitable encoders, decoders, character generator, and the like. In addition, timing control circuits are provided for properly interrelating the various operations. Some of these circuits may be included in module 43.

Considering the operation of system 20, including panel 10, assuming that a group of cathodes 26 and the anode 40 at a character position have been energized and are displaying a character, then at this time, the anode associated with this character position carries a generally positive potential, and the selected cathodes are at a suitably negative potential with respect to the anode. At this time, transistor 226, in the cathode circuit, is conducting, and its collector current or the cathode segment current is largely determined by the voltage drop across resistor 230 in the collector-emitter path. This voltage has the same magnitude as the voltage across resistor 266, of the bias network, which voltage is established by the programming current, since voltage cancelation is effected by (1) the voltage across the diode 270, and Vbe (base emitter voltage) of transistors 242 and (2) the voltages across resistors 268 annd 236 and Vbe of transistors 264 and 226. Since transistor 226 is in the active region and has high current again, there will be a very small base current through resistor 236, and this results in a negligible feedback current through the collector of transistor 242 and Zener diode 244.

Assuming that the panel has just displayed a character and the next character is about to be displayed, then the next anode logic signal, of about +5 volts, appearing at the output of circuit module and on a lead 44, 43 operates through the anode drive circuitry so that the anode which had been energized positive is driven negative, and the new anode, which had been at a negative level, is driven to a positive level in a manner to be described. Simultaneously, cathode logic signals, of about +5 volts, which appear at the outputs of module 43, and on leads 45, operate through the cathode drive circuitry to apply generally negative levels to these cathodes or cathode leads and generally positive levels to the other cathodes or cathode leads. For each selected cathode, transistor 254 conducts current, and the current is multiplied by diode 258 and transistor 256 and then level-shifted down by Zener diode 260 to provide base current to saturate the selected transistors 234.

However, before the newly selected cathodes glow and a character is actually displayed, a period of time known as re-ionization time occurs during which the required positive anode voltage is developed. During re-ionization time, when the cathode segment current, through the panel, is essentially zero, transistor 226 acts as a diode and the current through resistors 236 is large, this current being determined by the voltage across resistor 266 divided by resistors 236 and 230. This current is fed back to the multiplier circuit in the anode circuit to provide charge to the integrating capacitor 196 and thus to raise the anode bus 56 to the proper positive potential at which cathode glow will occur. This current, called feedback current, flows from the +100 volt supply, which is connected to bus 170, through transistor 172, lead 248, transistors 242 and 234 to bus 222. The current through transistor 172 is multiplied by transistor 174 and flows from the 100 volt supply and bus 170, through transistors 174 and 190 and through capacitor 196 to ground. As this current flows, capacitor 196 charges in a positive direction and raises the potential on bus 56 in a positive direction. In principle, the charge provided to the integrating capacitor 196 during the re-ionization time is equal to the current removed from the integrating capacitor during the cathode current ON-time in order for the system to be in equilibrium. The multi-collector transistor current sources 210 serve as cathode pull-up resistors, in accordance with the invention.

The program current, or the cathode current which flows when a cathode glows, is determined by the resistors 266 and 230, and, if the resistors are equal, the program current equals the cathode current, and, if they have the same ratio, then the program current and cathode current will be in the same ratio.

In the anode circuit, anode operating logic levels are applied to each of the anode circuits from leads 44, sequentially and in turn.

Resistor 116 and transistor 114 and their associated circuitry are a constant current source which is always conducting and causing a flow through transistor 78, Zener diode 74, and diode 70 of each anode as it receives positive logic level on lead 44. All other anodes receive a negative logic level which holds the anode off. This current flow to an anode provides base current to the anode transistor 50 which conducts and saturates and its emitter reaches the potential of bus 56. This is a relatively low potential which is too low to cause cathode glow. As capacitor 196 charges and bus 56 becomes more positive, the transistor 50 follows this potential rise, and, the bus 56 reaches a suitably high positive potential. When this potential is reached due to charging of capacitor 196, the energized cathodes exhibit cathode glow. As the circuit operates, the steady current flow in the constant current source represented by transistor 114 represents a drain on bus 56 and capacitor 196 which tends to lose voltage thereby. This loss is compensated for by current generated in transistor 120 and returned through transistors 130, 168, and 150 to bus 56.

What is claimed is:

1. A system for operating a gas-filled multiple-position display panel, said panel having a plurality of groups of glow cathode elements and an anode associated with each group, corresponding cathodes of the different groups being interconnected by a single common conductor, there thus being a single common conductor for each cathode element in each of said groups, said system comprising a plurality of cathode circuits, each cathode circuit including a connection to one of said common conductors, each circuit including a connection to a source of input cathode selecting signals and active circuit means responsive thereto, an anode circuit bus, a plurality of anode circuits, each anode circuit including (1) a first current flow path between said anode circuit bus and an anode in said display device, (2) a second current flow path between said anode circuit bus and a current source, and (3) means for receiving input anode energizing signals coupled to said second path, said first path including an active circuit element which couples the potential of said anode circuit bus to an anode, and an auxiliary circuit coupled between said anode bus and all of said cathode circuits and providing an auxiliary current flow path for said cathode circuits during the re-ionization time for the cathode elements in said display panel, said auxiliary circuit including means for generating anode operating potential, as current flows therethrough, and for applying said anode operating potential to said anode circuit bus.

2. The system defined in claim 1 wherein, in each anode circuit, said first current flow path extends from said anode circuit bus through an NPN transistor and a lead to an anode electrode in said panel, and said second current flow path and said means for receiving input signals includes a connection from an output terminal on a logic chip through a resistor to the input of a first NPN transistor, the collector of which is connected through a Zener diode and a PNP transistor to said anode circuit bus, the emitter of said first NPN transistor being connected to said current source which includes a second NPN transistor having its emitter connected to a bus, its base connected between said bus and the base electrode of said first NPN transistor, and its collector connected to the emitter-collector path of said first NPN transistor.

3. The system defined in claim 1 wherein each cathode circuit includes a terminal adapted to be connected to an output of a logic chip, said terminal being connected through a resistor to series-connected current multiplying transistors, the output of which is connected through a Zener diode (1) to a bus and (2) to first and second transistors which are connected in series to one of said common conductors in said panel, the base of said second transistor being connected through the emitter-collector path of a third transistor and Zener diode means to said auxiliary circuit, re-ionization current flowing through said first and third transistors to said auxiliary circuit.

4. The system defined in claim 1 and including a capacitor in said auxiliary circuit, said capacitor being coupled (1) to said anode circuit bus to apply its charge potential thereto, and (2) through a current multiplier circuit to all of said cathode circuits whereby, as each cathode circuit is energized at the beginning of a cathode display period, current flows from the energized cathode circuits to said capacitor which charges up to a potential which is sufficient in magnitude when applied to said anode circuit bus to cause cathode glow to take place.

5. The system defined in claim 4 and including auxiliary circuit loops coupled to said anode bus and feeding electrical current thereto and to said capacitor for maintaining charge on said capacitor as a glow discharge operation takes place and charge tends to drain away from said capacitor.

6. The system defined in claim 1 and including a connection from each common conductor in said panel through the collector-emitter path of a separate transistor to a source of reference potential, each separate transistor functioning in the nature of a resistor.

* * * * *